US010563642B2

(12) United States Patent
Najafi et al.

(10) Patent No.: US 10,563,642 B2
(45) Date of Patent: Feb. 18, 2020

(54) MODULAR STACKED VARIABLE-COMPRESSION MICROPUMP AND METHOD OF MAKING SAME

(71) Applicant: THE REGENTS OF THE UNIVERSITY OF MICHIGAN, Ann Arbor, MI (US)

(72) Inventors: Khalil Najafi, Ann Arbor, MI (US); Luis P. Bernal, Ann Arbor, MI (US); Seyed Amin Sandoughsaz Zardini, Ann Arbor, MI (US); Ali Besharatian, Santa Barbara, CA (US)

(73) Assignee: THE REGENTS OF THE UNIVERSITY OF MICHIGAN, Ann Arbor, MI (US)

( * ) Notice: Subject to any disclaimer, the term of this patent is extended or adjusted under 35 U.S.C. 154(b) by 254 days.

(21) Appl. No.: 15/627,692

(22) Filed: Jun. 20, 2017

(65) Prior Publication Data

US 2017/0363076 A1 Dec. 21, 2017

Related U.S. Application Data

(60) Provisional application No. 62/352,200, filed on Jun. 20, 2016.

(51) Int. Cl.

| | |
|---|---|
| ***F04B 19/00*** | (2006.01) |
| ***F04B 43/04*** | (2006.01) |
| ***F04B 25/00*** | (2006.01) |
| ***F04B 45/04*** | (2006.01) |
| ***F04B 45/047*** | (2006.01) |
| *B01L 3/00* | (2006.01) |

(52) U.S. Cl.
CPC ..... *F04B 19/006* (2013.01); *F04B 25/00* (2013.01); *F04B 43/046* (2013.01); *F04B 45/043* (2013.01); *F04B 45/045* (2013.01); *F04B 45/047* (2013.01); *B01L 3/50273* (2013.01)

(58) Field of Classification Search
CPC ..... F04B 19/006; F04B 25/00; F04B 45/043; F04B 45/045; F04B 45/047
USPC ..... 417/413.3, 480
See application file for complete search history.

(56) References Cited

U.S. PATENT DOCUMENTS 5,078,581 A * 1/1992 Blum ..... F04B 43/043 417/413.3
5,338,164 A * 8/1994 Sutton ..... F04B 43/046 417/413.2

(Continued)

FOREIGN PATENT DOCUMENTS

EP 0412270 A1 2/1991
WO WO 00/36302 * 6/2000

*Primary Examiner* — Charles G Freay
(74) *Attorney, Agent, or Firm* — Harness, Dickey & Pierce, P.L.C.

(57) ABSTRACT

A micropump assembly is comprised of modular stacked pump stages. The modular pump stages are preferably stacked vertically on top of each other. The stacked design allows each pumping chamber to be compressed by two pumping membranes and thereby provide twice the compression as compared to conventional planar pump designs. The stacked design also eliminates the need for bidirectional movement of the pumping membrane. Lastly, the number of stacked pumping stages can be changed post-fabrication to achieve the required pressure for a given application.

19 Claims, 14 Drawing Sheets

(56) References Cited

U.S. PATENT DOCUMENTS

| | | | | |
|---|---|---|---|---|
| 6,116,863 | A * | 9/2000 | Ahn | F04B 43/043 417/322 |
| 7,008,193 | B2 | 3/2006 | Najafi et al. | |
| 7,258,533 | B2 * | 8/2007 | Tanner | F04B 43/046 137/855 |
| 7,771,176 | B2 | 8/2010 | Weber | |
| 9,217,426 | B2 * | 12/2015 | Wackerle | F04B 43/04 |
| 2003/0231967 | A1 * | 12/2003 | Najafi | F04B 43/043 417/322 |
| 2014/0037468 | A1 | 2/2014 | Kloss et al. | |

* cited by examiner

MODULAR STACKED VARIABLE-COMPRESSION MICROPUMP AND METHOD OF MAKING SAME

CROSS-REFERENCE TO RELATED APPLICATIONS

This application claims the benefit of U.S. Provisional Application No. 62/352,200, filed on Jun. 20, 2016. The entire disclosure of the above application is incorporated herein by reference.

GOVERNMENT CLAUSE

This invention was made with government support under Grant No. HDTRA1-14-C-0011 awarded by the DOD/HDTRA. The Government has certain rights in this invention.

FIELD

The present disclosure relates to a modular stacked variable-compression micropump and method of making same.

BACKGROUND

Gas micropumps are a crucial component of many emerging devices such as handheld environmental and health monitoring systems, breath analyzers, gas sensors, mass spectrometers, gas chromatography (GC) systems, and some other Lab-on-Chip (LOC) devices. In all these applications the size, weight, power consumption and pumping performance, such as pressure difference and flow rate, are critical. In prior works, a cascaded peristaltic micropump has been presorted that uses a planar design to achieve high-pressure high-flow gas pumping through the use of multiple stages and bidirectional resonant forcing of pumping membranes. In this earlier design, both the number of stages and the cavity volume of each stage had to be preset in layout and fabrication. This limited the ability to change the number of stages and per-stage volume ratio, and reduced the yield. To solve these issues, the multistage pump in this disclosure is realized by vertically stacking a desired number of similar pump stages, and in some cases incorporating a "plug" of pre-determined volume inside the pumping cavity of each stage and/or using stages with various thickness to control the stage volume ratio and add much greater flexibility to characteristics of the final product.

The stacked design also allows each pumping chamber to be compressed by two pumping membranes (one from each adjacent stage), and thereby provide twice the compression of a planar pump. The dual membrane compression and decompression reduces the need for higher force actuation, making this design more attractive for electrostatic designs. Furthermore, the motion of the microvalves in this design contributes to increase pumping in the flow direction. More importantly, since only downward actuation is expected from electrostatically-actuated pump membranes, no symmetrical bidirectional membrane actuation is required. The pump can operate off-resonance as well as resonance.

This section provides background information related to the present disclosure which is not necessarily prior art.

SUMMARY

This section provides a general summary of the disclosure, and is not a comprehensive disclosure of its full scope or all of its features.

A micropump assembly is presented. The micropump is comprised of: a plurality of pump stages arranged vertically in relation to each other. Each pump stage includes a pumping chamber defined by a top wall and one or more side walls; a pumping membrane integrated into the top wall of the pumping chamber; a microvalve integrated into the top wall of the pumping chamber and adjacent to the pumping membrane; and an actuator disposed adjacent to the pumping membrane and the microvalve within the pumping chamber. The actuator is configured to actuate the pumping membrane and microvalve independently from each other. The top wall of the pumping chamber in a given pump stage forms the bottom of the pumping chamber in an adjacent pump stage stacked on top of the given pump stage and the microvalve in the given pump stage fluidly couples the pumping chamber of the given pump stage to the pumping chamber of the adjacent pump stage.

In another aspect of this disclosure, a pump stage for a micropump assembly is constructed with two or more pumping membranes. For example, the pump stage includes: a pumping chamber defined by at least two opposing walls; a first microvalve integrated in one of the two opposing walls; a second microvalve integrated into the other of the two opposing walls; and two pumping membranes integrated into the pump chamber and actuable to change pressure in the pumping chamber. One or more actuators may be configured to actuate the first microvalve and the second microvalve independently from the two pumping membranes.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 15:
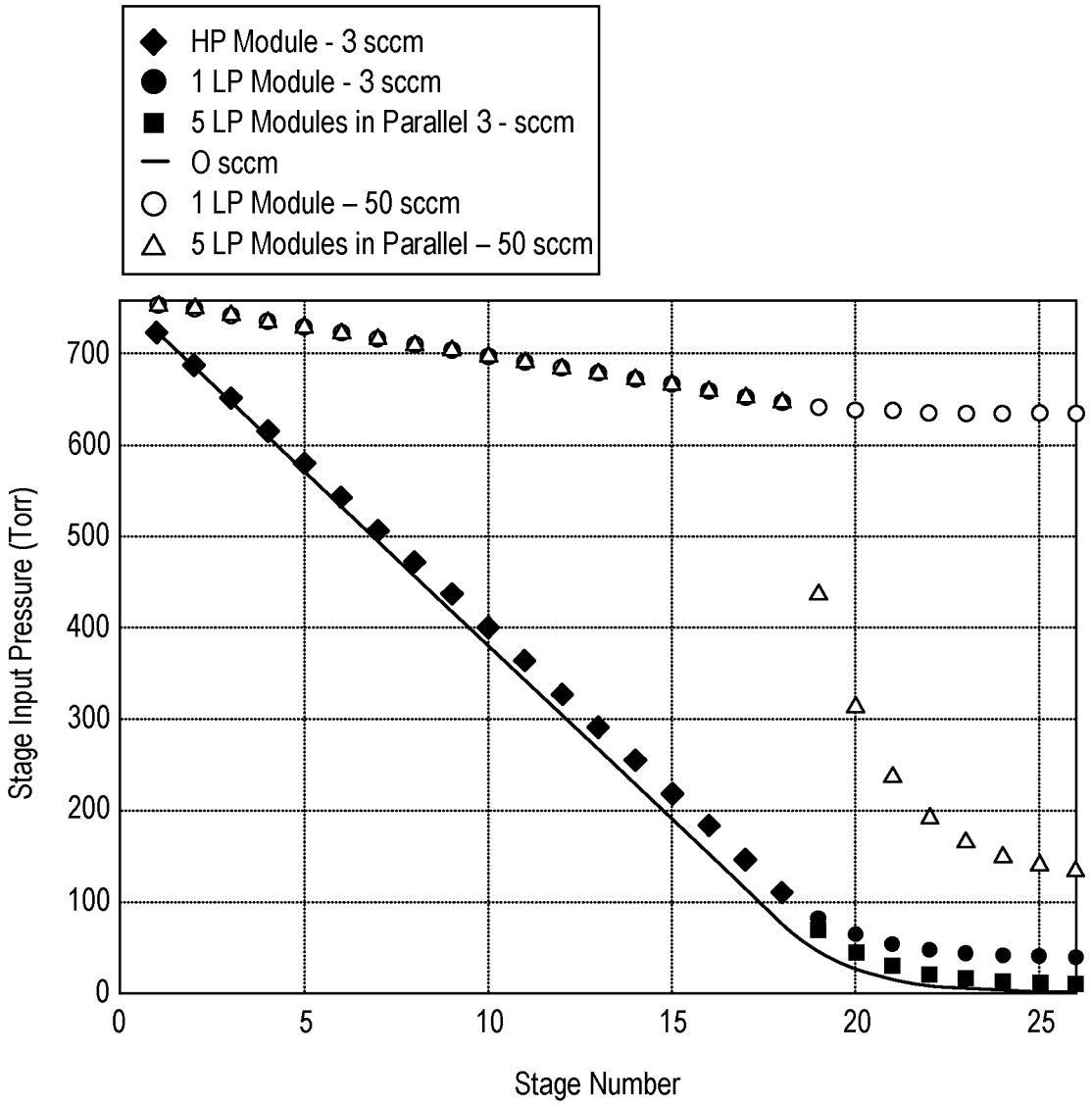
Figure 16:
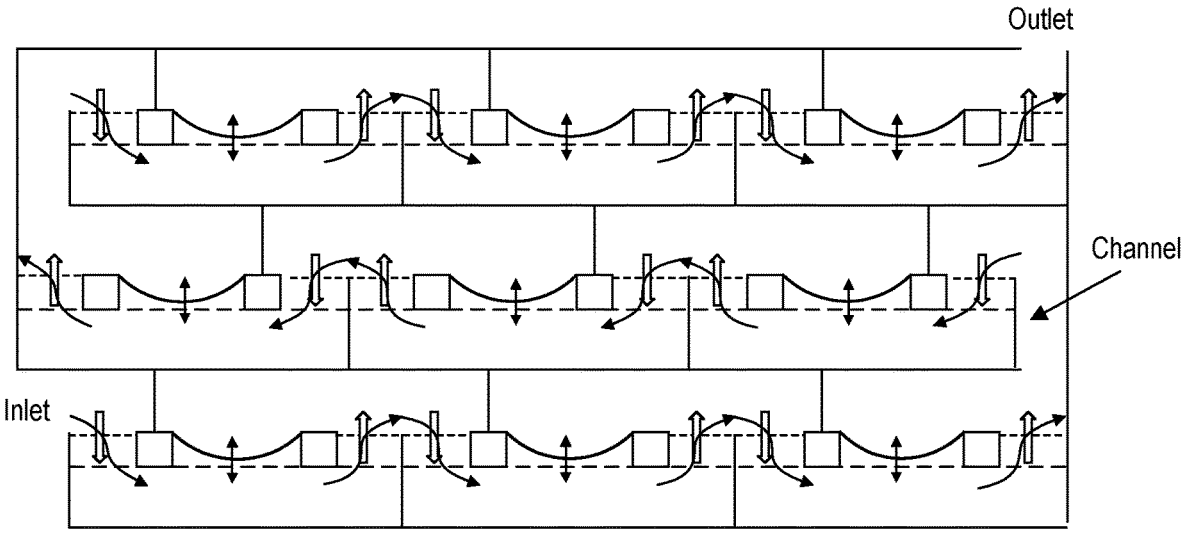
Figure 17:
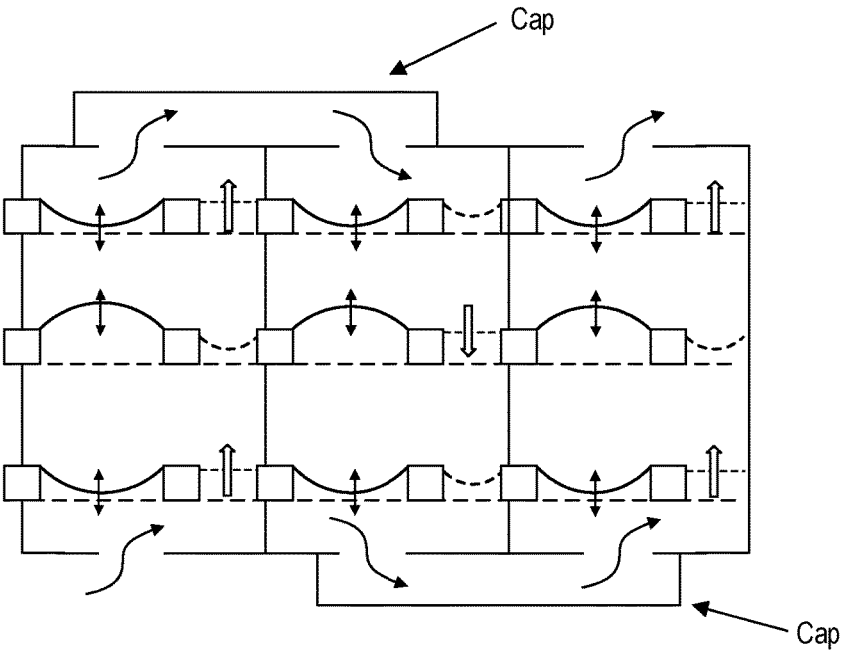

FIG. 15 is a graph showing stage input pressure for different operating conditions for micropumps having membranes volume displacement 32 nL and operating frequency 20 kHz; and FIGS. 16 and 17 are diagrams depicting example arrangements of the proposed stack design integrated with conventional planar designs.

Corresponding reference numerals indicate corresponding parts throughout the several views of the drawings.

DETAILED DESCRIPTION

Example embodiments will now be described more fully with reference to the accompanying drawings.

Figure 1:
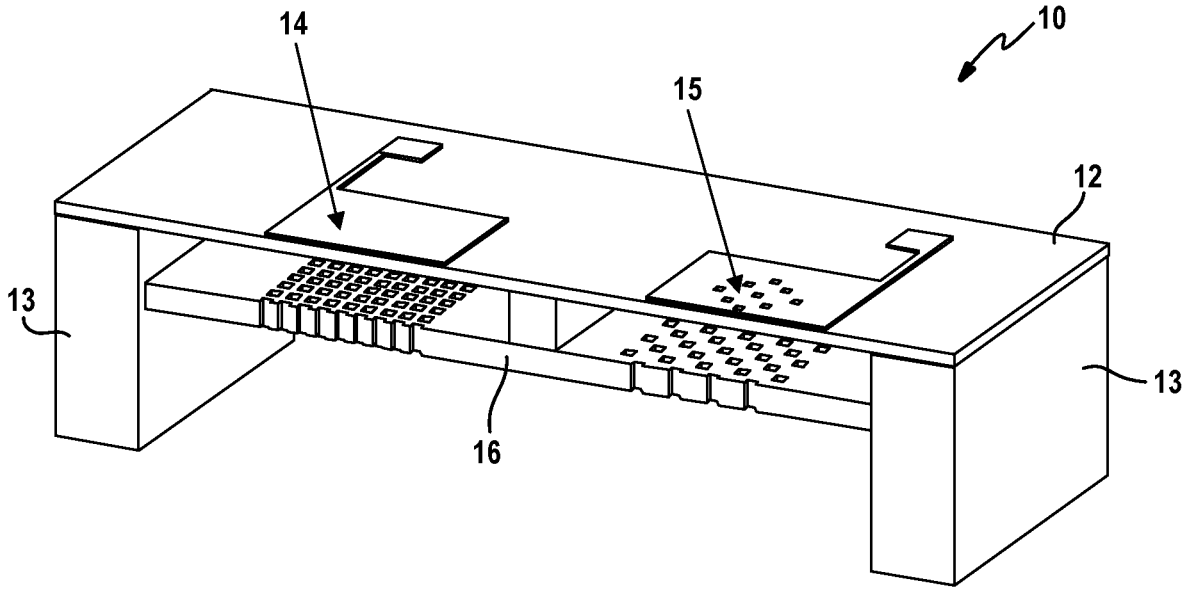
FIG. 1 is a perspective cross-sectional view of one pump module of a micropump assembly that can be used to build a stacked modular design.

FIG. 1 illustrates one pump module 10 for constructing a micropump assembly that uses a stacked modular design. The pump module 10 is comprised of a planar member 12 interconnected between two side support walls 13. A pumping membrane 14 and a microvalve 15 are integrated into the planar member 12. In one embodiment, the microvalve 15 is a checkerboard microvalve although other types of valves can be used. An actuator is also disposed adjacent to the pumping membrane 14 and the microvalve 15 and configured to actuate the pumping membrane 14 and the microvalve 15 independently from each other. In this example, the actuator is further defined as an electrode 16 disposed underneath each of the pumping membrane 14 and the microvalve 15. The pumping membrane 14 and/or the microvalve 15 are actuated towards the electrode in response to an electric actuation signal applied to one or both of the pumping membrane 14 and the microvalve 15. As will be further described below, the micropump assembly is fabricated on a micro scale (e.g., less than a centimeter) using microfabrication methods.

Figure 2A:
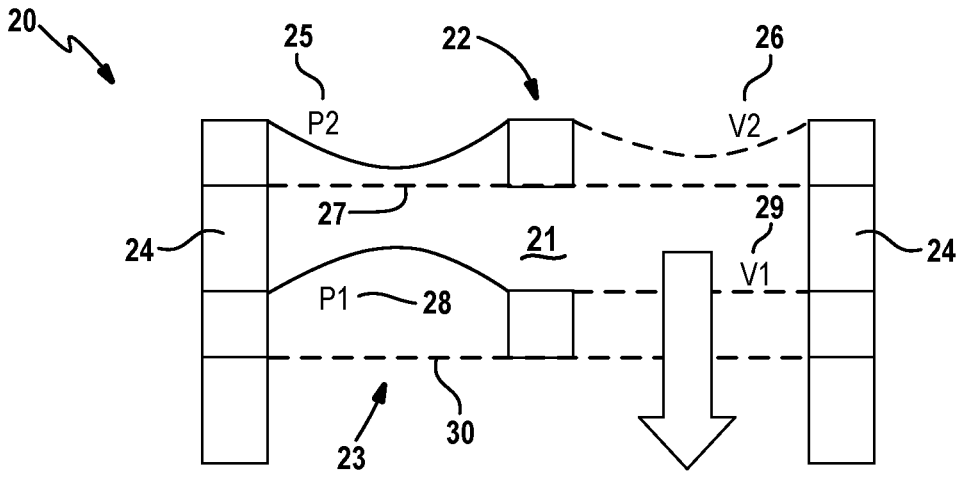
FIGS. 2A and 2B are diagrams of a single-stage micropump consisting of two pump modules vertically stacked and showing operation during a compression cycle and a decompression cycle, respectively.
Figure 2B:
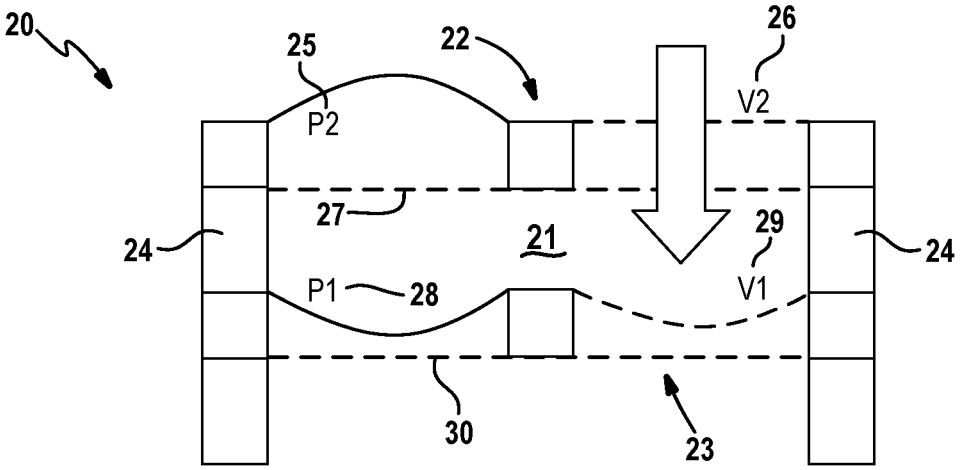

To construct a micropump, multiple pump modules 10 are stacked vertically on each other as shown in FIG. 2. In this example, a single stage micropump 20 is constructed by stacking two pump modules 10 vertically. Thus, a pumping stage collectively includes a pumping chamber 21, at least one pumping membrane 25, 28, at least one microvalve 26, 29 and an actuator. The pumping chamber 21 is defined by a top wall 22, a bottom wall 23 and one or more side walls 24. A top pumping membrane 25 as well as a top microvalve 26 are integrated into the top wall 22 of the pumping chamber 21. Similarly, a bottom pumping membrane 28 and a bottom microvalve 29 are integrated into the bottom wall 23 of the pumping chamber 21. A top electrode 27 is formed underneath the top wall 22 and a bottom electrode 30 is formed underneath the bottom wall 23. While the pump assembly is described as being stacked vertically, such configuration is not limiting and the pump modules may be stacked horizontally or oriented in another direction.

In operation, the two pumping membranes 25, 28 are actuated to change the pressure in the pumping chamber 21. In a first compression cycle, the actuation signals applied to the top pumping membrane 25 and the bottom pumping membrane 28 are out of phase with each other. That is, a voltage is applied across the top pumping membrane 25 and the adjacent electrode that actuates the top pumping membrane 25 towards the electrode; whereas, a voltage out of phase with respect to pumping membrane 25 is applied across the bottom pump membrane 28 and its adjacent electrode that actuates the bottom pumping membrane 28 away from the electrode. In this way, the pumping chamber 21 is compressed by both pumping membranes and thereby provides twice the compression of a conventional planar pump. Concurrently, a voltage is applied across the top microvalve 26 and its adjacent electrode and thereby actuating it into a close position, while the bottom microvalve 29 remains in an open position. Consequently, the airflow is out of the pumping chamber and through the open bottom microvalve 29.

In a subsequent decompression cycle, the actuation signals applied to the top pumping membrane 25 and the bottom pumping membrane 28 are reversed. That is, a voltage is applied across the top pumping membrane 25 and the adjacent electrode that actuates the top pumping membrane 25 away from the electrode; whereas, a voltage is applied across the bottom pump membrane 28 and its adjacent electrode that actuates the bottom pumping membrane 28 towards the electrode. Concurrently, a voltage is applied across the bottom microvalve 29 and its adjacent electrode and thereby actuating it into a close position, while the top microvalve 26 remains in an open position. Consequently, pumping chamber 21 is decompressed and airflow is into the pumping chamber through the open top microvalve 26. In this way, a one stage micropump can be achieved.

Figure 3A:
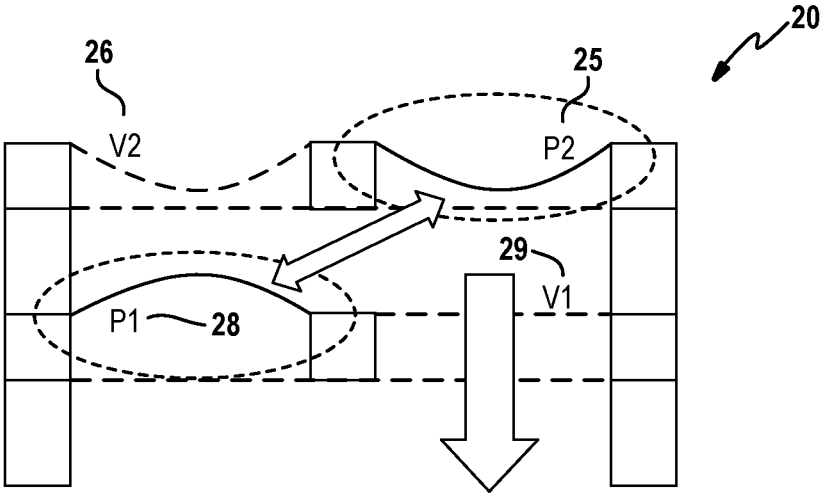
FIGS. 3A and 3B are diagrams of an alternative embodiment of a single-stage micropump during a compression cycle and a decompression cycle, respectively.
Figure 3B:
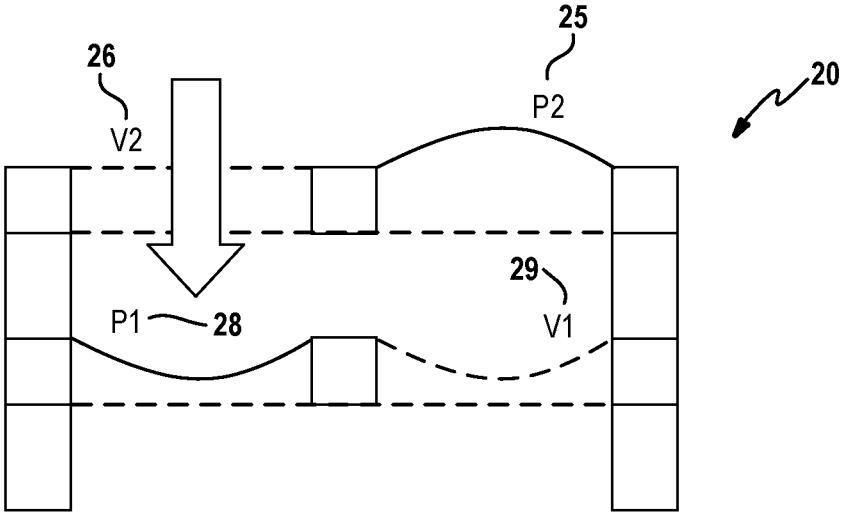

In FIG. 2, the top pumping membrane 25 is vertically aligned with the bottom pumping membrane 28 and the top microvalve 26 is vertically aligned with the bottom microvalve 29. FIGS. 3A and 3B illustrates an alternative embodiment of a single stage micropump 31. In this embodiment, the top microvalve 26 is vertically aligned with the bottom pumping membrane 28; whereas, the top pumping membrane 25 is vertically aligned with the bottom microvalve 29. Except with respect to this difference, the micropump 31 is substantially the same as the micropump 20 described above. Other placements for the pumping membranes and/or the microvalves (e.g., in the side walls) are also contemplated by this disclosure.

Figure 4:
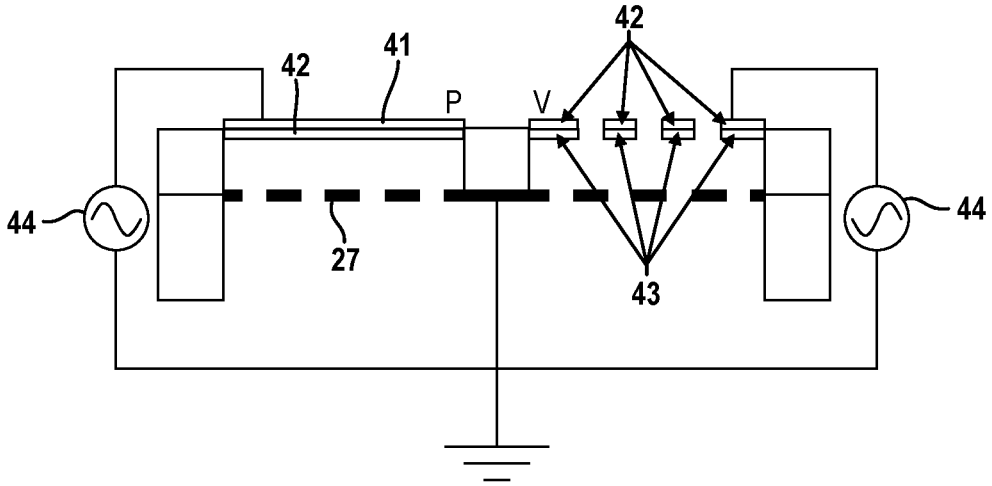
FIG. 4 is a diagram depicting an example actuator mechanism for the micropump assembly.

In these example embodiments, the pumping membranes and the microvalves are actuated electrostatically as further shown in FIG. 4. To do so, a contact 41 is formed on a top exposed surface of the pumping membrane 42 and the microvalve membrane 43. Because the pumping membrane can be actuated independently from the microvalve 43, each contact 41 is electrically coupled to a different voltage source 44. A voltage can be applied independently across the pumping membrane 42 and its adjacent electrode and the microvalve 43 and its adjacent electrode.

Pumping membranes are preferably actuated at the membrane resonance frequency, therefore bidirectional membrane movement with maximum deflection is obtained, i.e. pumping membranes move downward to the electrode in one subcycle and will move upward (move away from the electrode) in the next subcycle. This means in case of electrostatic actuation that there is no need for another electrode above the membrane to pull the membrane upward which simplifies the pump design and fabrication. This will improve the pumping performance, since each pumping chamber is compressed/decompressed by two pumping membranes (one from the top pump module and the other from the bottom module). Pumping membranes in adjacent pump modules are actuated by out of phase signals and therefore opposite membrane deflection direction is obtained (one is moving downward and the other moving upward). It should be noted that, actuating the membranes off-resonance will not stop the pumping operation and will only affect the pumping efficiency since upward deflection will be degraded. That is, in some embodiments, the same pump assembly can be operated at actuation frequencies other than resonance frequency.

Figure 5:
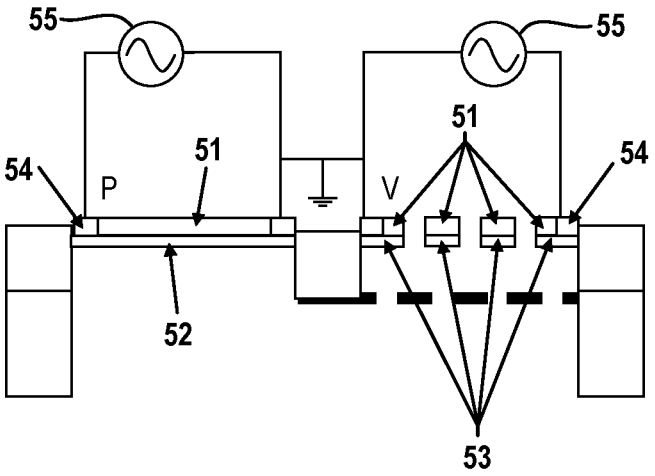
FIG. 5 is a diagram depicting an alternative actuator mechanism for the micropump assembly.

FIG. 5 depicts an alternative actuator mechanism for the micropump assembly. In this example, the pumping membranes and the microvalves are actuated piezoelectrically. A piezoelectric membrane 51 is formed on a top exposed surface of the pumping membrane 52 and the microvalve membrane 53. An electric contact 54 may be formed on each end of the piezoelectric membrane 51. The electric contacts 54 are in turn electrically coupled to a voltage source 55, such that a voltage can be applied independently to the piezoelectric membrane disposed on the pumping membrane 52 and to the piezoelectric membrane disposed on the microvalve 43. In case of piezoelectric actuation, bidirectional movement of membranes is achieved by controlling polarity of the actuation signal. While two particular actuator mechanisms have been described, other types of actuator mechanism for the pumping membranes and the valves fall within the broader aspects of this disclosure.

Figure 6A:
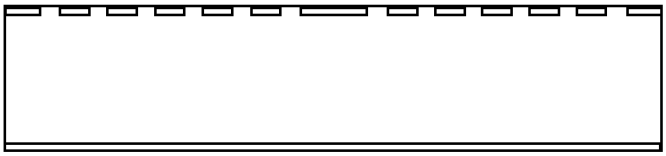
FIGS. 6A-6F are cross-sectional views illustrating an example fabrication process for a single pump module of the micropump assembly.

FIGS. 6A-6F illustrate an example fabrication process for a pump module in the proposed micropump assembly. The process begins with silicon wafers which are thermally oxidized to form the mask for boron doping. Referring to FIG. 6A, wafers are then boron doped to improve the conductivity of the electrode areas and provide heavily boron-doped etch stop for later wet etching. This step defines the holes (the only areas that are not doped) of the electrode and alignment jigs.

Figure 6B:
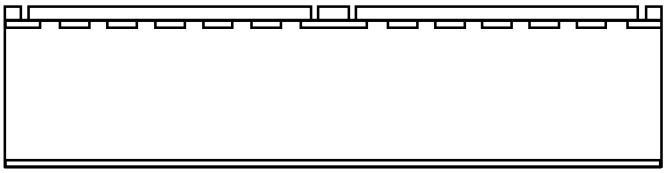
Figure 6C:
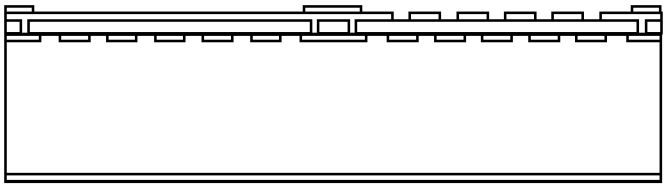
Figure 6D:
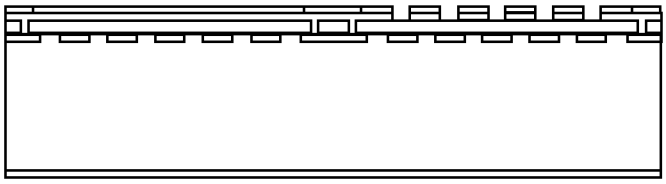

In FIG. 6B, a thick poly-silicon sacrificial layer is deposited using low pressure chemical vapor deposition (LPCVD) and patterned by deep reactive-ion etching (DRIE), using a very narrow ring-shaped mask that defines membrane edges. Membranes are formed by deposition (e.g., LPCVD and metal sputtering) and patterning of a thin oxide-nitride-oxide stack, a thick field-oxide with a thin nitride etch-stop for stress compensation, and a thin metal layer (e.g., Cr—Au layer) for electrostatic actuation as seen in FIGS. 6C and 6D.

Figure 6E:
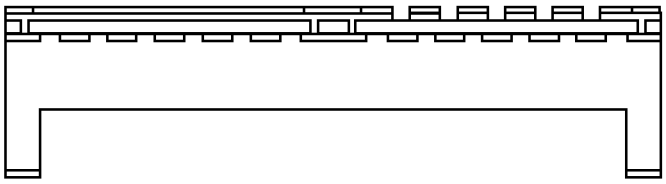
Figure 6F:
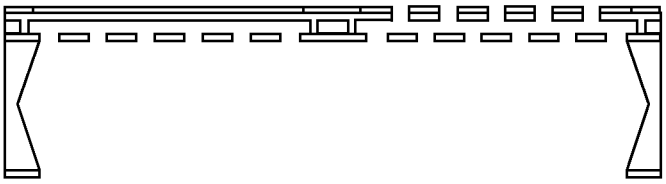

Next, an etch window is opened on the backside of the wafer by etching as seen in FIG. 6E. In this example, bulk silicon is etched using DRIE to minimize the wet-release time. Finally, membrane-electrode pairs are released through a dissolved wafer process and surface micromachining process, for example using ethylenediamine-pyrocatechol solution for the doping-selectivity and anisotropic silicon etch. This releases the boron-doped electrodes and the freestanding thin membrane. Since square membranes—aligned with crystal lines—are used, the etchant stops at crystal planes, leaving the bulk silicon for structural support. It is understood that this fabrication process is merely illustrative and variations in the arrangements, steps, and materials are contemplated by this disclosure.

Figure 7:
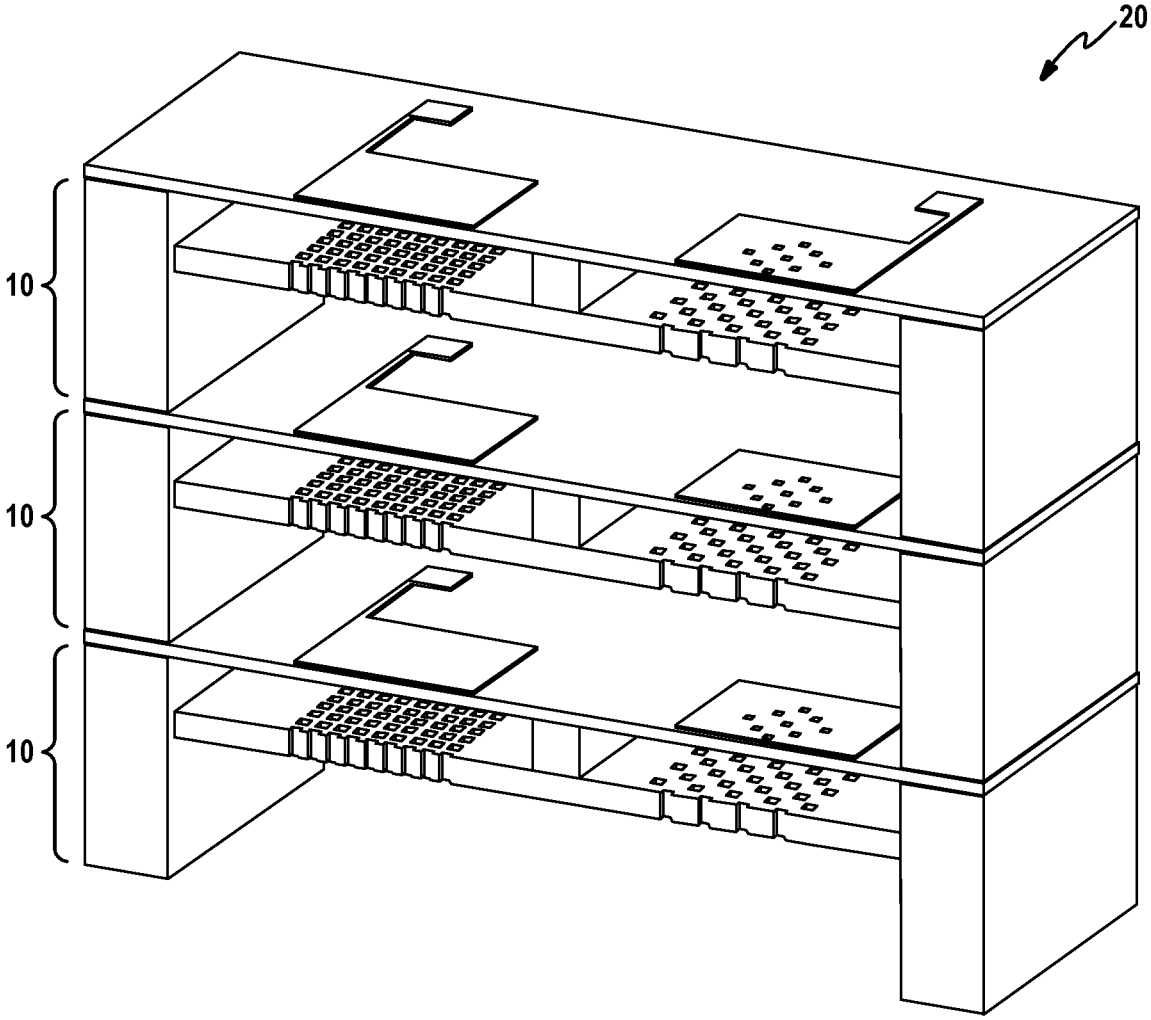
FIG. 7 is a perspective cross-sectional view of a micropump assembly comprised of three pump modules.

FIG. 7 depicts a two-stage micropump assembly 70. In this example, three pump modules 10 are arranged vertically in relation to each other. Each pump module includes a pumping membrane, a microvalve and an actuator as described above. In a given pump stage, the top wall of the pumping module forms the bottom of the pumping chamber in the adjacent pump stage stacked on top of the given pump stage. The microvalve fluidly couples the pumping chamber in one stage to the pumping chamber in another stage. In this embodiment, a microvalve is aligned vertically with the microvalve in an adjacent pumping stage. Thus, the micropump assembly 70 utilizes a multi-stage peristaltic design to uniformly distribute the total pressure difference across the pump stages.

Figure 8:
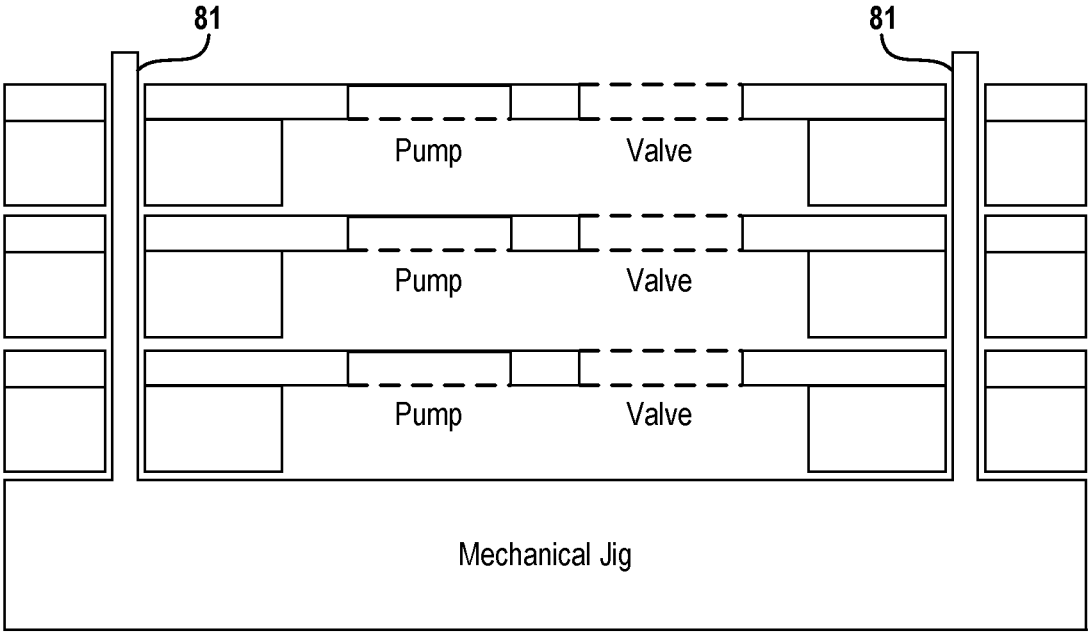
FIG. 8 is a diagram of a mechanical jig with three stacked pump modules.

FIG. 8 schematically depicts the stacking and aligning of a two-stage pump assembly using a mechanical jig. Two jig holes 81 are provided on the sides of each pumping stage for alignment. After stacking the desired number of stages, electrical connection is achieved using wire bonding between pads on each stage and those on a printed circuit board (PCB). The gaps between the stages are sealed using an adhesive epoxy, which also secures the entire microsystem to the mechanical jig and the PCB below. As the final packaging step, fluidic ports are connected to the whole system.

Figure 9A:
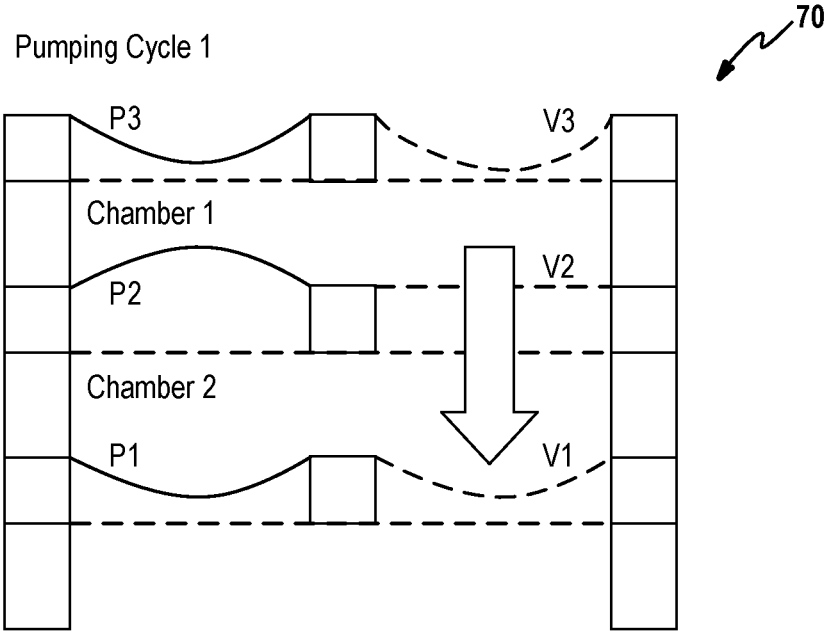
FIGS. 9A and 9B are diagrams of a two-stage micropump during two different pump cycles.
Figure 9B:
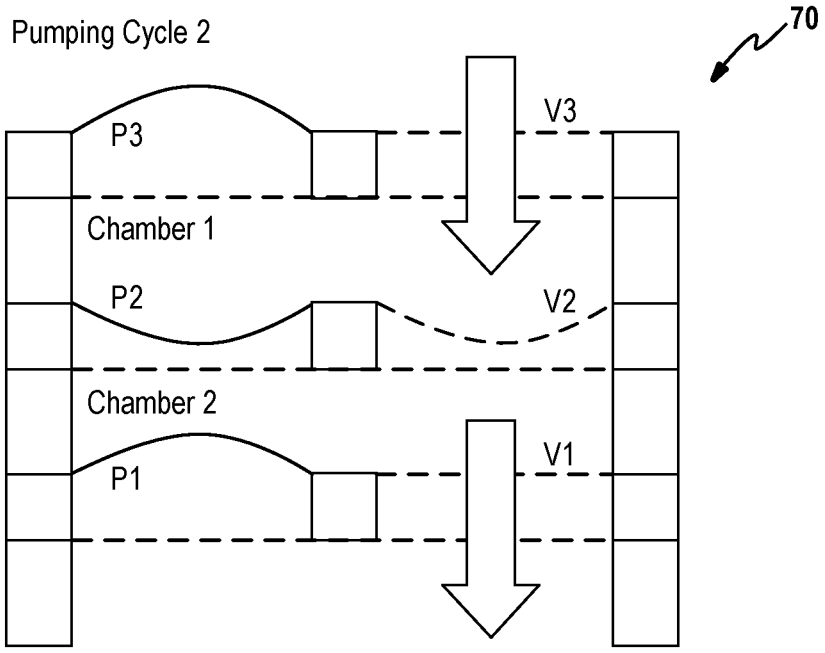

FIGS. 9A and 9B illustrate the operating principle of the two-stage pump assembly 70. Actuation signals applied to pumping membranes in adjacent chambers are out of phase. When a chamber is compressed, the previous and next chambers (at the top and bottom of it) are decompressed, and vice versa. As shown in FIG. 9A, chamber 1 is compressed by both the pumping membranes from the second and third modules (due to the phase difference between $P_2$ and $P_3$ membranes motion). Meanwhile, the microvalve ($V_3$) from the third module is closed and the microvalve from the second module $V_2$ is open, thus forcing gas to flow from chamber 1 to chamber 2. In the next pumping cycle, chamber 2 is compressed by first and second pumping membranes ($P_1$ and $P_2$) while chamber 1 is decompressed as seen in FIG. 9B. Once again, since $V_2$ is closed and $V_1$ is open, gas is pushed out of chamber 2 while it flows into chamber 1. By proper valve timing, gas always flows from the compressed chamber to the decompressed chamber. Once several pump stages are stacked on top of one another, only four actuation signals ($P_1$, $P_2$, $V_1$ and $V_2$) are needed to operate the entire micropump assembly, as the stages operate in a bucket-brigade manner.

Flow direction is determined by valve timing. In the example described above, flow direction is down. On the other hand, if valve timing is changed so that the voltage applied to V2 as described is applied to valves V1 and V3 and vice versa, the flow direction is reversed (i.e., upward). In this case, the valves do not contribute to pumping.

Since each pumping chamber is operated using two membranes, the stacked design provides twice the compression of a planar pump. The dual membrane compression/decompression eliminates the need for a higher force actuation. Furthermore, compared to a planar pump, microvalves of the proposed micropump assembly pump in the flow direction. More importantly, no summetrical bidirectional membrane actuation is required. Since only downward actuation is expected from pump membranes actuated electrostatically with a single electrode, upward motion of the pumping membranes and valves results from structural and fluidic coupling. Although electrical/structural/fluidic coupling can result in large membrane displacement at resonance, which is preferable, the pump can operate off-resonance as well.

Figure 10:
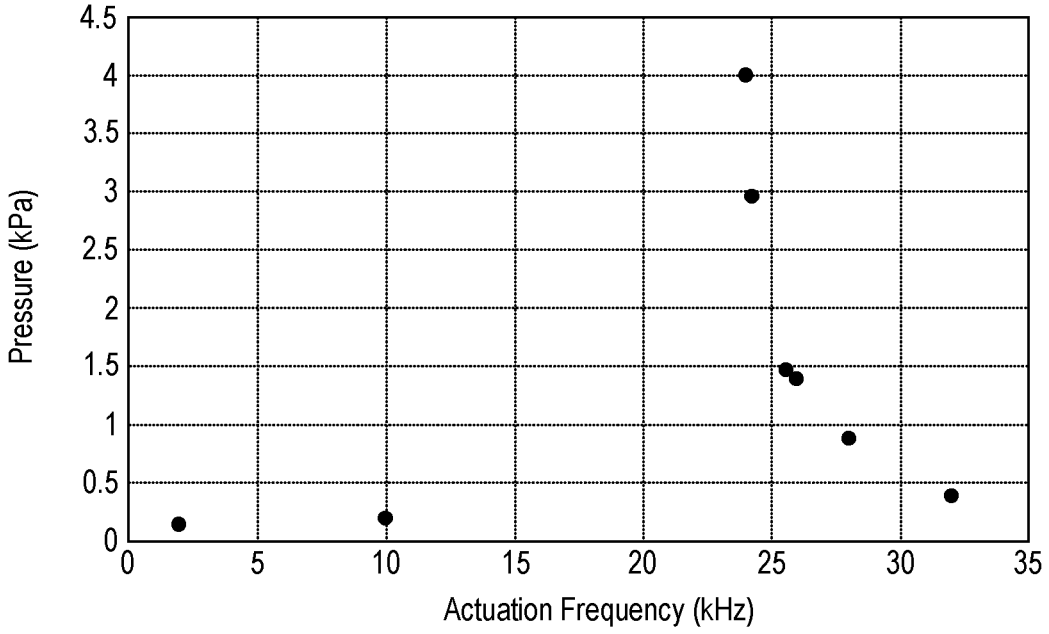
FIG. 10 is a graph showing the output pressure for zero flow rate in relation to frequency for a two-stage micropump.
Figure 11:
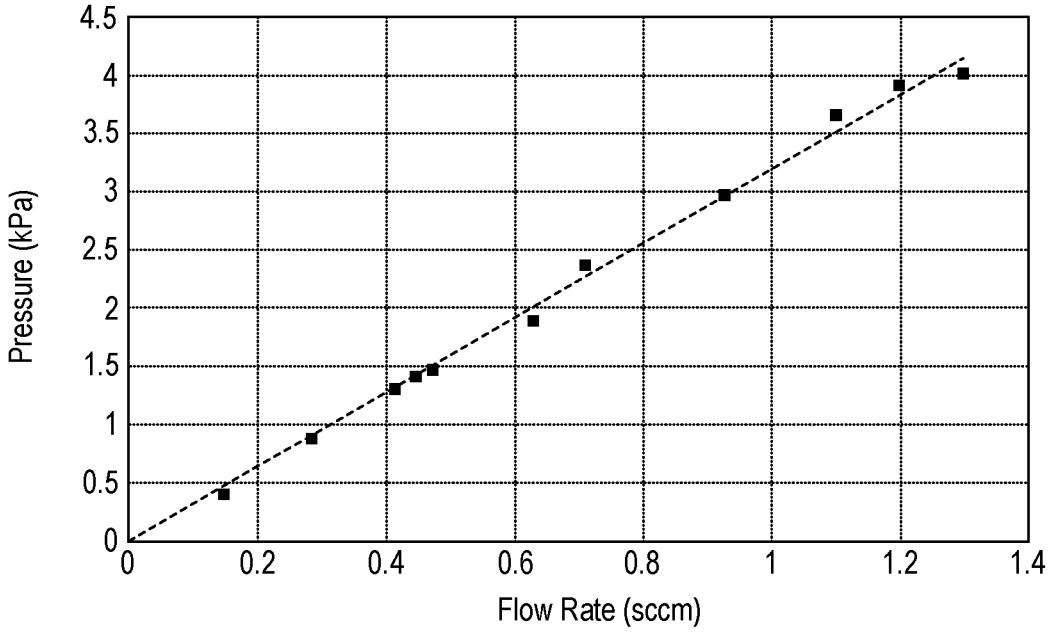
FIG. 11 is a graph showing the output pressure for zero flow rate in relation to maximum flow rate for a two-stage micropump.

As mentioned before, since two adjacent stages are driven using signals that are out of phase, four AC signals are needed to drive the micropump: two to actuate the pumping membranes ($P_1$, $P_2$) and two to actuate the microvalve membranes ($V_1$,$V_2$). In an example embodiment, the actuation signals are generated by a controller. For example, actuation signals may be generated by an RF generator and amplified to the pull-in voltage of the membranes using four power amplifiers. All membranes are actuated by bipolar AC voltages of 250 $V_{pk\text{-}pk}$ (±125V), to prevent charge accumulation on the membranes. To evaluate the fluidic performance of the micropump, it is connected to a flowmeter (e.g., Omega 1601A) and an absolute pressure sensor (e.g., Omega PX209) in series, using fluidic connections and plastic tubes. FIG. 10 shows the measured pressure for zero flow rate produced by the two-stage micropump assembly 70 at different actuation frequencies. As shown, a maximum pressure of 4 kPa is obtained at 24 kHz, and is achieved by only two stages, producing a high pressure of 2 kPa/stage. FIG. 11 shows the measured pressure vs. flow rate for the two-stage micropump assembly 70.

The input and output ports of the micropump are at atmospheric pressure before the pump starts operating. As pumping proceeds, the input pressure drops below atmospheric, while the output pressure is maintained at atmospheric. If all stages have equal chamber volumes, different pressure values build up across different micropump stages. This degrades the efficiency of the input-side stages, since these stages experience lower gas densities. In other words, a smaller mass of gas is displaced by the membrane per pumping cycle, resulting in less flow. To address this problem, stages with lower absolute pressure should have smaller volume. To maintain the same pressure drop across each stage, the ratio of the volume displaced by the pumping membrane to the volume size of the pumping chamber underneath has to be changed from stage to stage. This is especially critical in electrostatic micropumps where the actuation force is limited to ~5 kPa and any substantial increase over this value will impact the operation of that stage.

Figure 12:
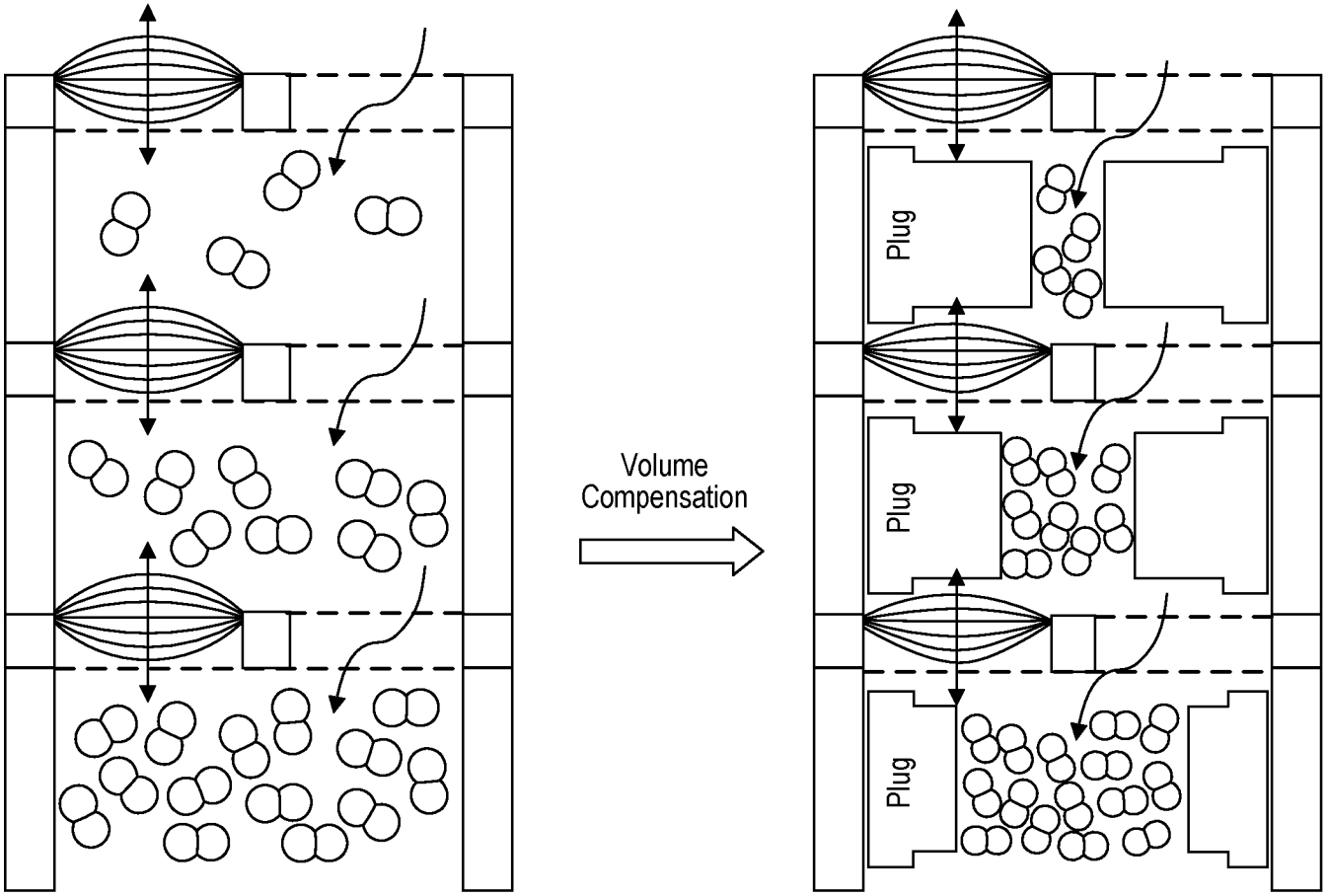
FIG. 12 is a diagram showing how variable volume ratio is achieved using custom-designed plugs, where the plug's hole diameter determines the volume ratio, i.e., $V_3>V_2>V_1$.
Figure 13:
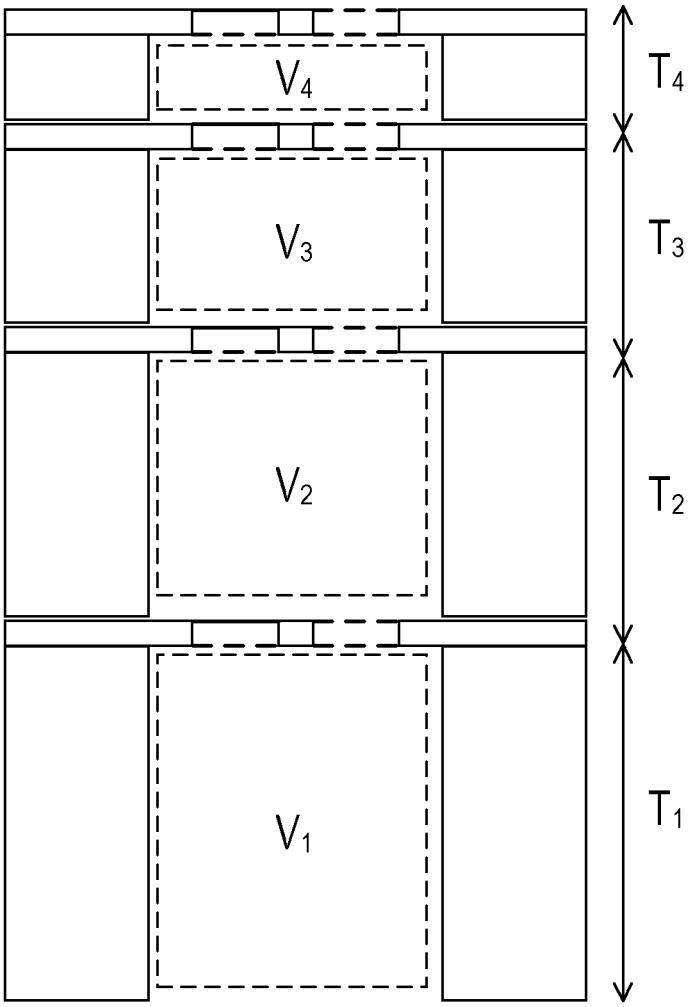
FIG. 13 is a diagram showing how variable volume ratio is achieved by stacking pump stages with different thicknesses.

One approach to changing the volume ratio is by placing custom designed micromachined fixed-diameter donut-shaped plugs with different hole diameters into the pumping chambers as seen in FIG. 12. The pumping chambers of stages with lower final absolute pressure are filled by plugs with smaller hole diameters to provide higher compression (top). The size of hole diameters is then varied across pump stages. It is noted that the change in volume ratio can be made by adding the plug into the chambers post-fabrication. In another variant, the size of the pumping chamber could also vary across pumping stages to vary volume ratio as seen in FIG. 13. In this proposed stacked design, it is preferable to change the height of the pumping chambers. Other techniques for changing the compression ratio are also contemplated by this disclosure.

Figure 14:
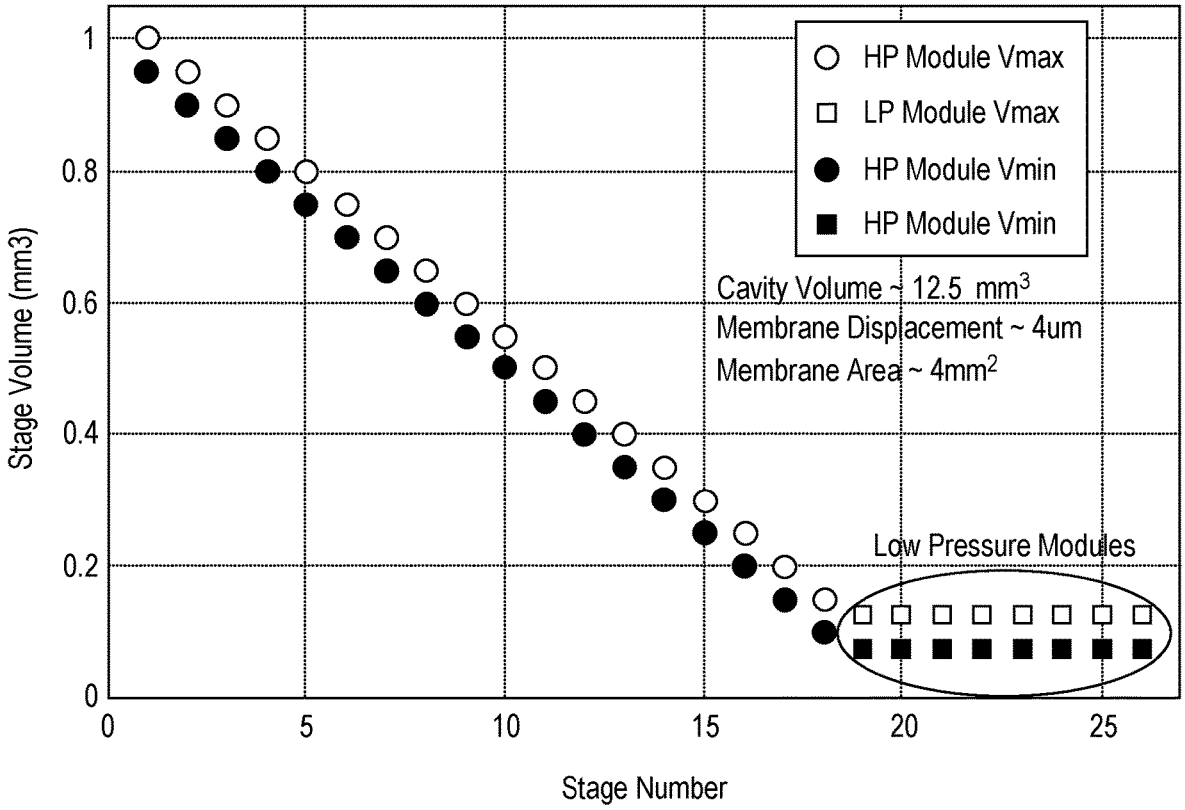
FIG. 14 is a graph showing calculated stage $V_{max}$ and $V_{min}$ for the high pressure and low pressure modules, where high pressure module corresponds to stage numbers 1-18 and the low pressure module corresponds to stage numbers 19-26.

Because of the small pressure change between pump stages of electrostatically actuated membranes, a relatively large number of stages is required to achieve higher pressure. Also, as mentioned before, because the input pressure and gas density are relatively low, the first few stages required relatively large volume displacement compared to the stage volume that has a small volume ratio. These considerations drive the proposed design of the micropump which consists of a high pressure module and one or more low pressure modules. FIG. 14 shows the calculated stage maximum and minimum volumes for such high pressure (HP) and low pressure (LP) modules. The high-pressure module has a variable-volume-ratio design per stage to maintain a constant pressure difference of 5 kPa across each of many stages (e.g., 17 stages) in that module. The low-pressure module has fixed volume ratio ($V_r$=0.6) for a lesser number of stages (e.g., 7 stages) in that module. The value used is determined based on MEMS fabrication considerations. It is understood that the plug hole diameter can be calculated based on the values shown in this figure.

The estimated performances at the operating conditions are shown in FIG. 15. As expected the pressure change between stages in the high pressure module is almost the same for all the stages. For the low pressure module the pressure change is smaller. The plot illustrates the effect of using one or five low pressure modules in parallel.

The effect of dead volume on the pumping performance is explained in the following sentences. The pressure difference generated by each stage is calculated using the below equation which ΔV represents the volume change due to the membranes displacement, V is the total cavity volume of each micropump stage, P is the atmospheric pressure and ΔP represents the pressure difference generated by each pumping stage.

$$\frac{\Delta V}{V} = \frac{\Delta P}{P} \tag{1}$$

As seen, the generated pressure difference is inversely proportional to the total volume of the cavity, therefore, theoretically reducing the cavity volume will increase the generated pressure difference (ΔP).

Micropumps having the proposed vertically stacked design can also be integrated with conventional planar designs. Two example arrangements are shown in FIGS. 16 and 17. Other arrangements combing the proposed stack design with the conventional planar design also fall within the scope of this disclosure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A micropump assembly, comprising:

a plurality of pump stages arranged vertically in relation to each other, where each pump stage includes a pumping chamber defined by a top wall and one or more side walls;

a pumping membrane integrated into the top wall of the pumping chamber;

a microvalve integrated into the top wall of the pumping chamber and adjacent to the pumping membrane; and an actuator disposed adjacent to the pumping membrane and the microvalve within the pumping chamber and configured to actuate the pumping membrane and microvalve independently from each other;

wherein, for a given pump stage in the plurality of pump stages, the top wall of the pumping chamber in the given pump stage forms the bottom of the pumping chamber in an adjacent pump stage stacked on top of the given pump stage and the microvalve in the given pump stage fluidly couples the pumping chamber of the given pump stage to the pumping chamber of the adjacent pump stage.

2. The micropump assembly of claim 1 wherein the pumping membrane in the given pump stage is actuated concurrently with the pumping membrane in the adjacent pump stage to change pressure in the pumping chamber.

3. The micropump assembly of claim 1 wherein the pumping membrane and the microvalve in the given pump stage are actuated one of electrostatically or piezoelectrically.

4. The micropump assembly of claim 1 wherein the actuator in the given pump stage is further defined as an electrode disposed underneath each of the pumping membrane and the microvalve within the pumping chamber of the given pump stage, such that the pumping membrane and the microvalve in the given pump stage are actuated towards the electrodes in response to an electric actuation signal applied to the electrodes.

5. The micropump assembly of claim 4 wherein the electric actuation signals applied to pumping membranes in adjacent pump stages are out of phase with each other.

6. The micropump assembly of claim 1 wherein the microvalve in the given pump stage aligns vertically with the microvalve in the adjacent pump stage.

7. The micropump assembly of claim 1 wherein the microvalve in the given pump stage is further defined as a checkerboard microvalve.

8. The micropump assembly of claim 1 wherein the pumping chamber in each pump stage includes a plug disposed therein, such that size of the plugs vary across the pump stages, thereby changing the compression ratio across the pump stages.

9. The micropump assembly of claim 1 wherein the height of the pumping chambers varies across the pump stages, thereby changing the compression ratio across the pump stages.

10. The micropump assembly of claim 1 wherein each dimension of the pumping chamber is less than one centimeter.

11. A pump stage for a micropump assembly, comprising:

a pumping chamber defined by at least two opposing walls;

a first microvalve integrated in one of the two opposing walls;

a second microvalve integrated into the other of the two opposing walls;

two pumping membranes integrated into the pump chamber and actuable to change pressure in the pumping chamber; and one or more actuators in the pumping chamber and configured to actuate the first microvalve and the second microvalve independently from the two pumping membranes.

12. The pump stage of claim 11 wherein the first microvalve, the second microvalve and the two pumping membranes are actuated electrostatically.

13. The pump stage of claim 11 wherein the one or more actuators are further defined as an electrode disposed adjacent to each of the first microvalve, the second microvalve and the two pumping membranes.

14. The micropump assembly further comprises a plurality of pump stages arranged vertically in relation to each other, wherein each pump stage is constructed according to claim 11, such that a top wall of the pumping chamber in a given pump stage forms a bottom of the pumping chamber in an adjacent pump stage stacked on top of the given pump stage and the first microvalve in the given pump stage fluidly couples the pumping chamber of the given pump stage to the pumping chamber of the adjacent pump stage.

15. The micropump assembly of claim 14 wherein, for a given pump stage, the first microvalve fluidly couples to a first adjacent pump stage arranged above the given pump stage and the second microvalve fluidly couples to a second adjacent pump stage arranged below the given pump stage.

16. The micropump assembly of claim 14 wherein the first microvalve in a given pump stage aligns vertically with microvalves of a first adjacent pump stage arranged above the given pump stage and the second microvalve in a given pump stage aligns vertically with microvalves of a second adjacent pump stage arranged below the given pump stage.

17. The micropump assembly of claim 14 wherein for a given pump stage, each dimension of the pumping chamber is less than one centimeter.

18. The micropump assembly of claim 14 wherein the pumping chamber in each pump stage includes a plug disposed therein, such that size of the plugs vary across the pump stages.

19. The micropump assembly of claim 14 wherein the height of the pumping chambers varies across the pump stages, thereby changing the compression ratio across the pump stages.

* * * * *